US010311852B2

(12) United States Patent
Roe

(10) Patent No.: US 10,311,852 B2
(45) Date of Patent: Jun. 4, 2019

(54) TWO TONE WHISTLE

(71) Applicant: Dale Roe, Kansas City, KS (US)

(72) Inventor: Dale Roe, Kansas City, KS (US)

( * ) Notice: Subject to any disclaimer, the term of this patent is extended or adjusted under 35 U.S.C. 154(b) by 0 days.

(21) Appl. No.: 15/604,828

(22) Filed: May 25, 2017

(65) Prior Publication Data

US 2019/0096380 A1 Mar. 28, 2019

(51) Int. Cl.

| | |
|---|---|
| ***G08B 3/02*** | (2006.01) |
| ***G10K 5/00*** | (2006.01) |
| *G09F 9/00* | (2006.01) |

(52) U.S. Cl.

CPC ..... *G10K 5/00* (2013.01); *G08B 3/02* (2013.01); *G09F 9/00* (2013.01)

(58) Field of Classification Search

CPC ..... G10K 5/00; G08B 3/02; G09F 9/00
USPC ..... 116/137 R, 140, 225, 307, 324; 446/202, 446/204, 206, 397
See application file for complete search history.

(56) References Cited

U.S. PATENT DOCUMENTS

| | | | | | |
|---|---|---|---|---|---|
| 696,814 | A * | 4/1902 | Hatch | G10K 5/00 | 446/206 |
| 1,744,570 | A * | 1/1930 | Paget | A61F 2/20 | 181/142 |
| 1,867,903 | A * | 7/1932 | Wilcox | G10K 5/00 | 446/205 |
| 2,053,982 | A * | 9/1936 | Weiss | G10K 5/00 | 116/137 R |
| 2,056,623 | A * | 10/1936 | Scott | G10K 5/00 | 446/206 |
| 2,113,396 | A * | 4/1938 | Butterfield | G10K 5/00 | 116/137 R |
| 2,245,484 | A * | 6/1941 | Leavens | G10K 5/02 | 116/137 A |
| 2,737,757 | A * | 3/1956 | Liebelt | G10K 5/00 | 116/137 A |
| 3,120,213 | A * | 2/1964 | Mulligan | A63B 71/0672 | 116/137 R |
| 4,940,451 | A * | 7/1990 | Leady | A01M 31/004 | 446/202 |
| 5,002,006 | A * | 3/1991 | Ehrenreich | G10K 5/00 | 116/137 R |
| 5,515,808 | A * | 5/1996 | Edlund | G10K 5/00 | 116/137 R |
| 5,564,360 | A * | 10/1996 | Wright | G10K 5/00 | 116/137 R |
| 7,037,167 | B2 * | 5/2006 | Primos | A01M 31/004 | 446/204 |
| 7,428,878 | B2 * | 9/2008 | Kim | G10K 5/00 | 116/137 R |
| 7,987,809 | B2 * | 8/2011 | Uribe | G10K 5/00 | 116/137 R |

(Continued)

*Primary Examiner* — Nimeshkumar D Patel
*Assistant Examiner* — Tania C Courson
(74) *Attorney, Agent, or Firm* — The Iwashko Law Firm, PLLC; Lev Ivan Gabriel Iwashko

(57) ABSTRACT

A two-tone whistle that alters an audible patch that reduces confusion when multiple athletic events are played with whistles being blown during the multiple athletic events. The two-tone whistle includes a mouthpiece, a resonate chamber, a ball, a lever and a lanyard aperture. The slotted edge is integral to the lever and is adapted to move up or down as the lever moves up or down producing a first audible pitch and a second audible pitch, wherein the first audible pitch is lower than the second audible pitch.

9 Claims, 4 Drawing Sheets

(56) References Cited

U.S. PATENT DOCUMENTS

| | | | | |
|---|---|---|---|---|
| 2003/0116078 | A1* | 6/2003 | Topman | G10K 5/00 116/137 R |
| 2010/0261403 | A1* | 10/2010 | Shishido | G10K 5/00 446/204 |
| 2016/0223170 | A1* | 8/2016 | Farina | F21L 4/00 |
| 2017/0213536 | A1* | 7/2017 | Yu | G10K 5/00 |

* cited by examiner

TWO TONE WHISTLE

BACKGROUND OF THE INVENTION

Field of the Invention

The present invention is a whistle. More specifically, the present invention is a two-tone whistle.

Description of the Related Art

Comparable products on the market do not offer an effective way for referees and officials to be heard during athletic competitions, especially when multiple events are taking place in the same venue. Likewise, similar products in existence do not allow persons to alter the tone of the pitch in a given whistle, making it difficult to differentiate when officials are actually making a call on a play or if something entirely different is occurring at the time.

What is needed is a two-tone whistle that alters an audible pitch that reduces confusion when multiple athletic events are played with whistles being blown during the multiple athletic events.

SUMMARY OF THE INVENTION

The present invention is a whistle. More specifically, the present invention is a two-tone whistle.

The two-tone whistle includes a mouthpiece adapted to be blown into by a person to generate an audible pitch, a resonate chamber receiving air blown into the mouthpiece, a ball contained within a semi-circular portion of the resonate chamber, a toggle lever disposed on an exterior side portion of the resonate chamber, the toggle lever is adapted to control the audible pitch by moving the toggle lever up or down, a lanyard aperture receiving a lanyard that is adapted to insert the lanyard through the lanyard aperture and a slotted edge placed above the ball contained within the resonate chamber, the slotted edge is integral to the toggle lever, the slotted edge is adapted to move up as the toggle lever moves up and is adapted to move down as the toggle lever moves down, the audible pitch is produced by the ball that is adapted to vibrate within the semi-circular portion of the resonate chamber against the slotted edge from the received blown air.

It is an object of the present invention to provide a two-tone whistle that features a whistle made out of all durable, high-grade plastic that functions in all conditions and an easily adjustable switch for added durability, convenience and flexibility.

It is an object of the present invention to provide a two-tone whistle that has an incorporated lever on the back or side of the whistle that allows refereeing officials to have access to two distinct and noticeably louder tones when making calls in a matter of seconds, ensuring a seamless and hassle-free experience every time.

It is an object of the present invention to provide a two-tone whistle that reduces confusion when multiple athletic events are played with whistles being blown during the multiple athletic events.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention however the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
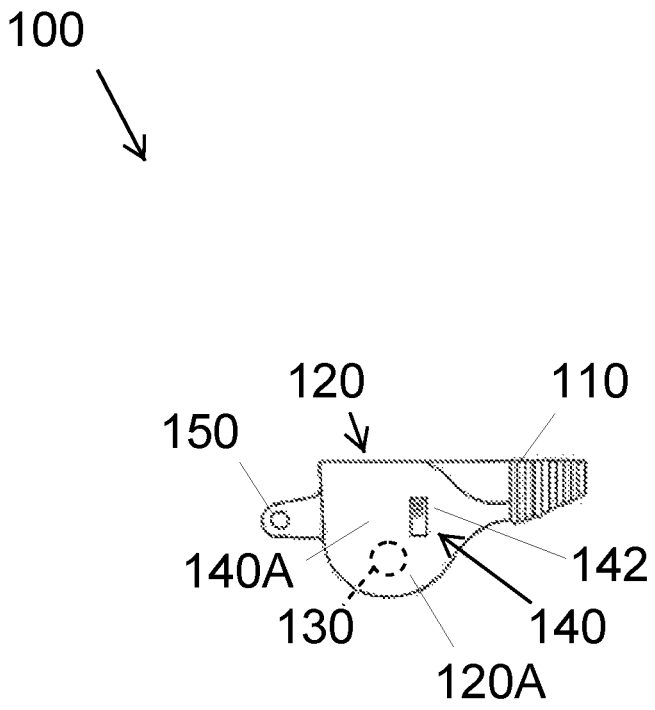
FIG. 1A illustrates a first side view of a two-tone whistle, in accordance with one embodiment of the present invention.

FIG. 1A illustrates a first side view of a two-tone whistle 100, in accordance with one embodiment of the present invention.

The two-tone whistles 100 may include a mouthpiece 110, a resonate chamber 120, a ball 130, a lever 140 and a lanyard aperture 150.

The mouthpiece 110 may be adapted to be blown into by a person such as a referee or other suitable person to generate an audible pitch. The resonate chamber 120 may receive air blown into the mouthpiece 110. The ball 130 may be contained within a semi-circular portion 120A of the resonate chamber 120 and the audible pitch may be produced by the ball 130 adapted to vibrate within the semi-circular portion 120A of the resonate chamber 120 from the received blown air. The ball 130 may be made of cork, synthetic cork or other suitable material. The lever 140 may be disposed on an exterior side portion 140A of the resonate chamber 120. The lever 140 may be a toggle lever 142 that may be adapted to control the audible pitch by moving the toggle lever 142 up or down. The lanyard aperture 150 may receive a lanyard (not shown) that may be adapted to insert the lanyard through the lanyard aperture 150.

The two-tone whistle 100 may be made of plastic, metal or other suitable material.

Figure 1B:
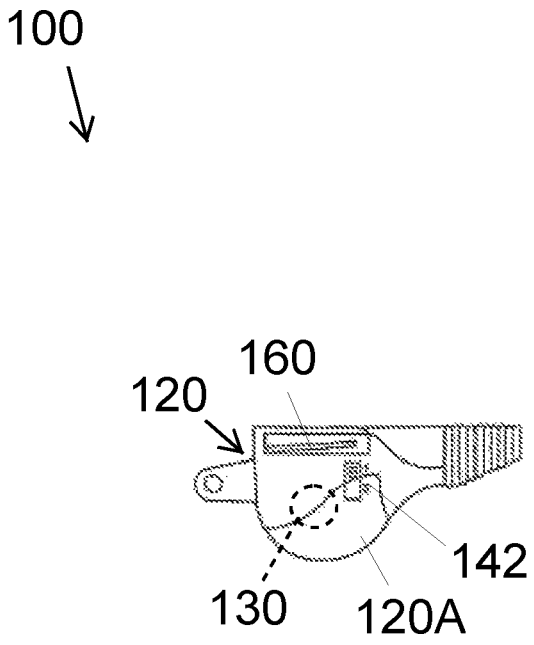
FIG. 1B illustrates a first cutaway side view of a two-tone whistle, in accordance with one embodiment of the present invention.

FIG. 1B illustrates a first cutaway side view of a two-tone whistle 100, in accordance with one embodiment of the present invention.

The two-tone whistle 100 may include a slotted edge 160. The slotted edge 160 may be integral to the toggle lever 142 and is adapted to move up as the toggle lever 142 moves up. The audible pitch may be produced by the ball 130 that may be adapted to vibrate within the semi-circular portion 120A of the resonate chamber 120 against the slotted edge 160. When the slotted edge 160 may be adapted to move up, the ball 130 travels further within the resonate chamber 120 and it produces a first audible pitch.

Figure 1C:
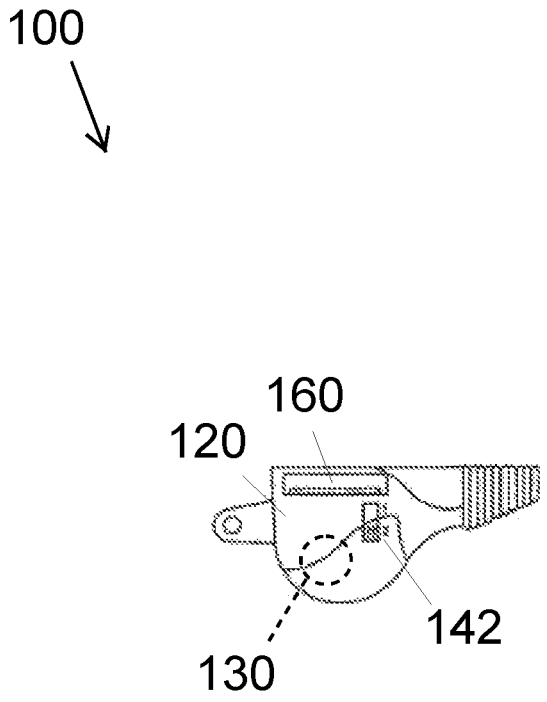
FIG. 1C illustrates a second cutaway side view of a two-tone whistle, in accordance with one embodiment of the present invention.

FIG. 1C illustrates a second cutaway side view of a two-tone whistle 100, in accordance with one embodiment of the present invention.

The slotted edge 160 may be integral to the toggle lever 142 and is adapted to move down as the toggle lever 142 moves down. When the slotted edge 160 may be adapted to move down, the ball 130 travels a shorter distance within the resonate chamber 120 and it produces a second audible pitch, wherein the first audible pitch is lower than the second audible pitch. The difference between the first audible pitch and the second audible pitch is distinguishable so that the two-tone whistle 100 reduces confusion when multiple athletic events are played with whistles being blown at the first audible pitch and the second audible pitch during the multiple athletic events.

Figure 1D:
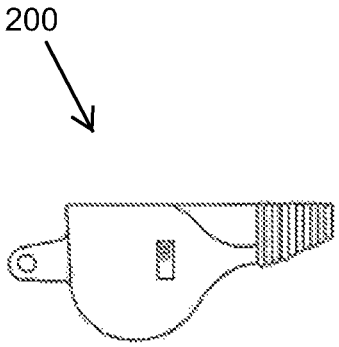
FIG. 1D illustrates a first side view of a two-tone pea less or ball less whistle 200, in accordance with one embodiment of the present invention.

FIG. 1D illustrates a first side view of a two-tone pea less or ball less whistle 200, in accordance with one embodiment of the present invention.

While the present invention has been related in terms of the foregoing embodiments those skilled in the art will recognize that the invention is not limited to the embodiments described. The present invention may be practiced with modification and alteration within the spirit and scope of the appended claims. Thus, the description is to be regarded as illustrative instead of restrictive on the present invention.

What is claimed is:

1. A two-tone whistle, comprising:

a mouthpiece adapted to be blown into by a person to generate an audible pitch;

a resonate chamber receiving air blown into the mouthpiece;

a ball contained within a semi-circular interior portion of the resonate chamber;

a toggle lever disposed on an exterior side portion of the resonate chamber, the toggle lever is adapted to control the audible pitch by moving the toggle lever up or down;

a lanyard aperture receiving a lanyard that is adapted to insert the lanyard through the lanyard aperture; and a slotted edge placed above the ball contained within the resonate chamber, the slotted edge is integral to the toggle lever, the slotted edge is adapted to move up as the toggle lever moves up and is adapted to move down as the toggle lever moves down, the audible pitch is produced by the ball that is adapted to vibrate within the semi-circular portion of the resonate chamber against the slotted edge from the received blown air.

2. The two-tone whistle according to claim 1, wherein the ball is made of cork.

3. The two-tone whistle according to claim 2, wherein the ball is made of synthetic cork.

4. The two-tone whistle according to claim 1, wherein the slotted edge is adapted to move up, the ball travels further within the resonate chamber and produces a first audible pitch.

5. The two-tone whistle according to claim 4, wherein the slotted edge is adapted to move down, the ball travels a shorter distance within the resonate chamber and it produces a second audible pitch.

6. The two-tone whistle according to claim 5, wherein the first audible pitch is lower than the second audible pitch.

7. The two-tone whistle according to claim 1, wherein the two-tone whistle is made of plastic.

8. The two-tone whistle according to claim 1, wherein the two-tone whistle is made of metal.

9. A two-tone whistle, comprising:

a mouthpiece adapted to be blown into by a person to generate an audible pitch;

a resonate chamber having a semi-circular interior portion, the resonate chamber receiving air blown into the mouthpiece;

a toggle lever disposed on an exterior side portion of the resonate chamber, the toggle lever controls the audible pitch by moving the toggle lever up or down;

a lanyard aperture receives a lanyard and inserts the lanyard through the lanyard aperture; and a slotted edge, the slotted edge is integral to the toggle lever.

* * * * *